US007900900B2

(12) United States Patent
Kotani

(10) Patent No.: US 7,900,900 B2
(45) Date of Patent: Mar. 8, 2011

(54) SHEET HANDLING DEVICE AND SHEET HANDLING METHOD

(75) Inventor: Kaname Kotani, Himeji (JP)

(73) Assignee: Glory Ltd., Hyogo (JP)

( * ) Notice: Subject to any disclaimer, the term of this patent is extended or adjusted under 35 U.S.C. 154(b) by 290 days.

(21) Appl. No.: 12/169,276

(22) Filed: Jul. 8, 2008

(65) Prior Publication Data

US 2010/0007080 A1 Jan. 14, 2010

(51) Int. Cl.
*G07D 9/00* (2006.01)

(52) U.S. Cl. ..... 270/47; 270/60; 270/19; 194/206; 194/229

(58) Field of Classification Search ..... 270/47, 270/60, 36, 13, 19; 194/206, 229
See application file for complete search history.

(56) References Cited

U.S. PATENT DOCUMENTS

| | | | | |
|---|---|---|---|---|
| 5,772,197 | A * | 6/1998 | Aoki et al. | 270/58.08 |
| 6,219,503 | B1 * | 4/2001 | Miyake et al. | 399/85 |
| 6,273,413 | B1 | 8/2001 | Graef | |
| 6,381,443 | B1 * | 4/2002 | Kawata et al. | 399/407 |
| 2003/0006548 | A1 * | 1/2003 | Murata et al. | 271/256 |
| 2005/0067748 | A1 * | 3/2005 | Fujii et al. | 270/58.08 |

FOREIGN PATENT DOCUMENTS

| | | | |
|---|---|---|---|
| JP | 2000-11238 | A | 1/2000 |
| JP | 2003-157461 | A | 5/2003 |
| JP | 2004-149264 | A | 5/2004 |
| JP | 2005-293389 | A | 10/2005 |

* cited by examiner

*Primary Examiner* — Patrick Mackey
(74) *Attorney, Agent, or Firm* — Roberts Mlotkowski Safran & Cole, P.C.; Thomas W. Cole

(57) ABSTRACT

A sheet handling device includes a main transport path, a temporarily holding section provided in the main transport path, a transport section, a detection section provided at a predetermined detection position in the main transport path and a controller. The temporarily holding section includes a looped transport path. The controller performs a procedure including the steps of (I) transporting the sheet traveling along the main transport path to the looped transport path, (II) transporting another sheet along the main transport path, (III) controlling the transportation of the sheet and the transportation of said another sheet in response to the arrival of said another sheet at the detection position such that the sheets are stacked into a bunch in the looped transport path with certain parts of the sheets being aligned and (IV) repeating the steps (II) and (III) as required.

15 Claims, 9 Drawing Sheets

SHEET HANDLING DEVICE AND SHEET HANDLING METHOD

BACKGROUND OF THE INVENTION

1. Field of the Invention

The present invention relates to a sheet handling device and a sheet handling method.

2. Description of Related Art

As an example of a sheet handling device for handling sheets such as bills, checks and tickets, Japanese Unexamined Patent Publication No. 2003-157461 discloses a bill deposit machine. In this bill deposit machine, bills fed into a casing through a deposit port are checked first by a discriminating unit as to whether they are acceptable or not. If two or more bills are recognized as unacceptable, the bills are rejected and discharged in the form of a bunch through a return port. In this bill deposit machine, the rejected bills are sequentially dropped on a stage and stacked into a bunch of bills. However, the bill deposit machine cannot align the edges of the stacked bills. Therefore, if the bunch discharged out of the return port includes a bill of different size and the edges of the bills are not aligned, the user may fail to catch a bill of a shorter length and drop it. Further, the bunch of misaligned bills is not preferable in view of appearance.

Japanese Unexamined Patent Publication No. 2004-149264 discloses a stacking device capable of stacking bills of different sizes into a bunch with the rear edges of the bills being aligned. This stacking device is configured such that the bills are sequentially fed and stacked in approximately rectangular box-shaped stacking space. A stopper which corresponds to the length of the fed bills is provided in the stacking space such that the bills are stacked in the stacking space with their rear edges being in contact with a rear wall of the stacking space. In this stacking device, the state of the stopper has to be changed depending on the length of the bills fed in the stacking space. For changing the state of the stopper, the length of the bills must be detected in advance. If every bill fed in the stacking space has different size, the state of the stopper has to be changed every time when the bill is fed in. This is disadvantageous because the bills cannot be stacked rapidly.

A specification of U.S. Pat. No. 6,273,413 discloses a banking machine including a sheet bunching mechanism including therein a first transport path and a second transport path connected to a middle part of the first transport path. In this sheet handling mechanism, transportation of a bill on the first transport path and transportation of a bill on the second transport path are synchronized such that the bills are stacked at the intersection of the first and second transport paths with their front edges being aligned. For successively stacking a plurality of bills according to this sheet handling mechanism, a bunch of bills has to move back and forth in the first transport path around the intersection. This increases time required to stack the bills. Further, large space is required in a casing because the transport path has to be long enough to move the bills back and forth.

Japanese Unexamined Patent Publication No. 2000-11238 discloses a paper money receiving and paying machine provided with a storage part which winds the paper money. The paper money receiving and paying machine is able to store bills of different sizes one by one and deliver out the stored bills one by one with reliability. However, the machine is not able to stack the bills into a bunch.

Further, Japanese Unexamined Patent Publication No. 2005-293389 discloses a paper money processor including a temporary storage part which winds the paper money. The temporary storage part temporarily stores the bills after the discrimination and delivers out the bills stored therein. Just like the winding storage part described above, the temporary storage part is not able to stack the bills into a bunch. If the temporary storage part and the sheet bunching mechanism are both adopted, the size of the sheet handling device is inevitably increased.

SUMMARY OF THE INVENTION

With the foregoing in mind, the present invention has been achieved. An object of the invention is to downsize a sheet handling device capable of stacking a plurality of sheets into an aligned bunch and to provide a sheet handling device and a sheet handling method capable of rapidly performing the stacking procedure.

According to an aspect of the present invention, the sheet handling device includes: a casing having an opening through which a sheet passes; a storage section provided in the casing to store the sheet; a main transport path connecting the opening and the storage section; a temporarily holding section provided in the main transport path to temporarily hold the sheet; a transport section transporting the sheet along the main transport path; a detection section provided at a predetermined detection position in the main transport path to detect the arrival of the sheet traveling along the main transport path at the detection position; and a controller controlling the storage section, the temporarily holding section and the transport section based on the detection result of the detection section.

The temporarily holding section includes a looped transport path capable of transporting the sheet in a revolving fashion independently from the main transport path. The controller performs a procedure including the steps of: (I) transporting the sheet traveling along the main transport path to the looped transport path of the temporarily holding section, (II) transporting another sheet along the main transport path, (III) controlling the transportation of the sheet on the looped transport path and the transportation of said another sheet on the main transport path in response to the arrival of said another sheet at the detection position such that said another sheet is transported to the looped transport path and the sheets are stacked into a bunch at a predetermined position in the looped transport path with certain parts of the sheets being aligned and (IV) repeating the steps (II) and (III) as required.

In this configuration, the temporarily holding section includes the looped transport path capable of transporting the sheet in a revolving fashion independently from the main transport path. The looped transport path makes it possible to stack a plurality of bills into a neatly aligned bunch. To be more specific, the sheet traveling along the main transport path (a first sheet) is transported to the looped transport path of the temporarily holding section and another sheet (a second sheet) is transported along the main transport path. Then, the transportation of the first sheet on the looped transport path and the transportation of the second sheet on the main transport path are controlled in response to the arrival of the second sheet at the detection position in the main transport path. As a result, the first and second sheets are stacked into a bunch at the predetermined position in the looped transport path with certain parts of the first and second sheets being aligned. The "certain parts" of the sheets may be, for example, the front edges or the rear edges of the sheets. In this manner, a plurality of sheets are stacked into a bunch with the certain parts thereof being aligned.

Every time the bunch of sheets is revolved along the looped transport path, an additional sheet is stacked onto the bunch with a certain part of the additional sheet being aligned with the corresponding part of the bunch. Since the bunch of sheets is revolved along the looped transport path to stack a plurality of sheets, time required to stack them is reduced as compared with the case where the bunch is reciprocated on the transport path.

Further, in this configuration, the temporarily holding section also functions as a stacking system. Therefore, the space for the stacking system is saved as compared with the case where the stacking system separate from the temporarily holding section is provided.

The controller may further perform the step of: (V) transporting the bunch formed in the temporarily holding section along the main transport path and discharging the bunch out of the casing through the opening.

According to this step, a neatly aligned bunch of a desired number of sheets is discharged out of the casing through the opening. Since a plurality of sheets are discharged at one time, the user hardly fails to take every sheet. Further, as the sheets are aligned, the user is able to easily grab the bunch and the sheets are less likely to escape from the user's hand.

When two or more sheets are fed into the casing through the opening one by one, the controller may be adapted to stack the sheets into a bunch in the temporarily holding section with certain parts of the sheets being aligned.

When two or more sheets are discharged out of the casing, the controller may be adapted to deliver the two or more sheets out of the storage section one by one, stack the delivered sheets into a bunch in the temporarily holding section with certain parts of the sheets being aligned and discharge the bunch out of the casing through the opening.

The storage section may be adapted to wind the sheets one by one to store the sheets in the storage section and deliver the wound sheets one by one out of the storage section.

In the sheet stacking procedure using the looped transport path, the sheets have to be transported to the temporarily holding section one by one. The winding storage section is capable of winding the sheets one by one to store them and delivering out the wound sheets one by one. Therefore, the storage section is able to transport the sheets one by one from the storage section to the temporarily holding section with reliability. This winding storage section is suitable for the sheet stacking procedure.

The sheet handling device may further include a delivery section storing the bunch formed in the temporarily holding section and delivering the sheets one by one from the bunch, wherein the controller is adapted to transport the bunch formed in the temporarily holding section to the delivery section and store the sheets delivered out of the delivery section one by one in the storage section.

When the storage section is configured to wind the sheets one by one to store them, the bunch of sheets formed in the temporarily holding section cannot directly be stored in the storage section. Therefore, the bunch of sheets is transported from the temporarily holding section to the delivery section. Then, the sheets are delivered one by one out of the delivery section to the storage section. In this manner, the sheets are stored one by one in the storage section.

The sheet handling device may further include a cassette which is detachably attached to the casing and capable of storing the sheets to replenish the storage section and the sheets collected from the storage section.

According to another aspect of the present invention, the sheet handling method is a method for discharging a sheet in the storage section out of the casing through an opening.

The method includes the steps of: (i) transporting a sheet delivered out of the storage section along a main transport path and transporting the sheet to a looped transport path in a temporarily holding section provided in the main transport path; (ii) delivering another sheet out of the storage section and transporting said another sheet along the main transport path; (iii) controlling the transportation of the sheet on the looped transport path and the transportation of said another sheet on the main transport path in response to the arrival of said another sheet at a predetermined position in the main transport path such that said another sheet is transported to the looped transport path and the sheets are stacked into a bunch at a predetermined position in the looped transport path with certain parts of the sheets being aligned; (iv) repeating the steps (ii) and (iii) as required and (v) transporting the bunch formed in the temporarily holding section along the main transport path and discharging the bunch out of the casing through the opening.

According to still another aspect of the present invention, the sheet handling method is a method for storing a sheet fed through an opening.

The method includes the steps of: (i) transporting the sheet fed through the opening along a main transport path and transporting the sheet to a looped transport path in a temporarily holding section provided in the main transport path; (ii) transporting another sheet fed through the opening along the main transport path; (iii) controlling the transportation of the sheet on the looped transport path and the transportation of said another sheet on the main transport path in response to the arrival of said another sheet at a predetermined position in the main transport path such that said another sheet is transported to the looped transport path and the sheets are stacked into a bunch at a predetermined position in the looped transport path with certain parts of the sheets being aligned; and (iv) repeating the steps (ii) and (iii) every time the sheet is fed through the opening.

The method may further include the step of (v) transporting the bunch formed in the temporarily holding section to a delivery section, delivering the sheets of the bunch one by one out of the delivery section and storing the sheets in a storage section.

The method may further include the step of (vi) transporting the bunch formed in the temporarily holding section along the main transport path and discharging the bunch through the opening when the storage of the sheets is cancelled.

DETAILED DESCRIPTION OF THE INVENTION

Hereinafter, as an example of the sheet handling device of the present invention, an embodiment of a cash accept/dispense machine will be described with reference to the drawings. The description of the preferred embodiment is provided only for explanation purpose and does not limit the present invention, an object to which the present invention is applied and use of the invention.

Figure 1:
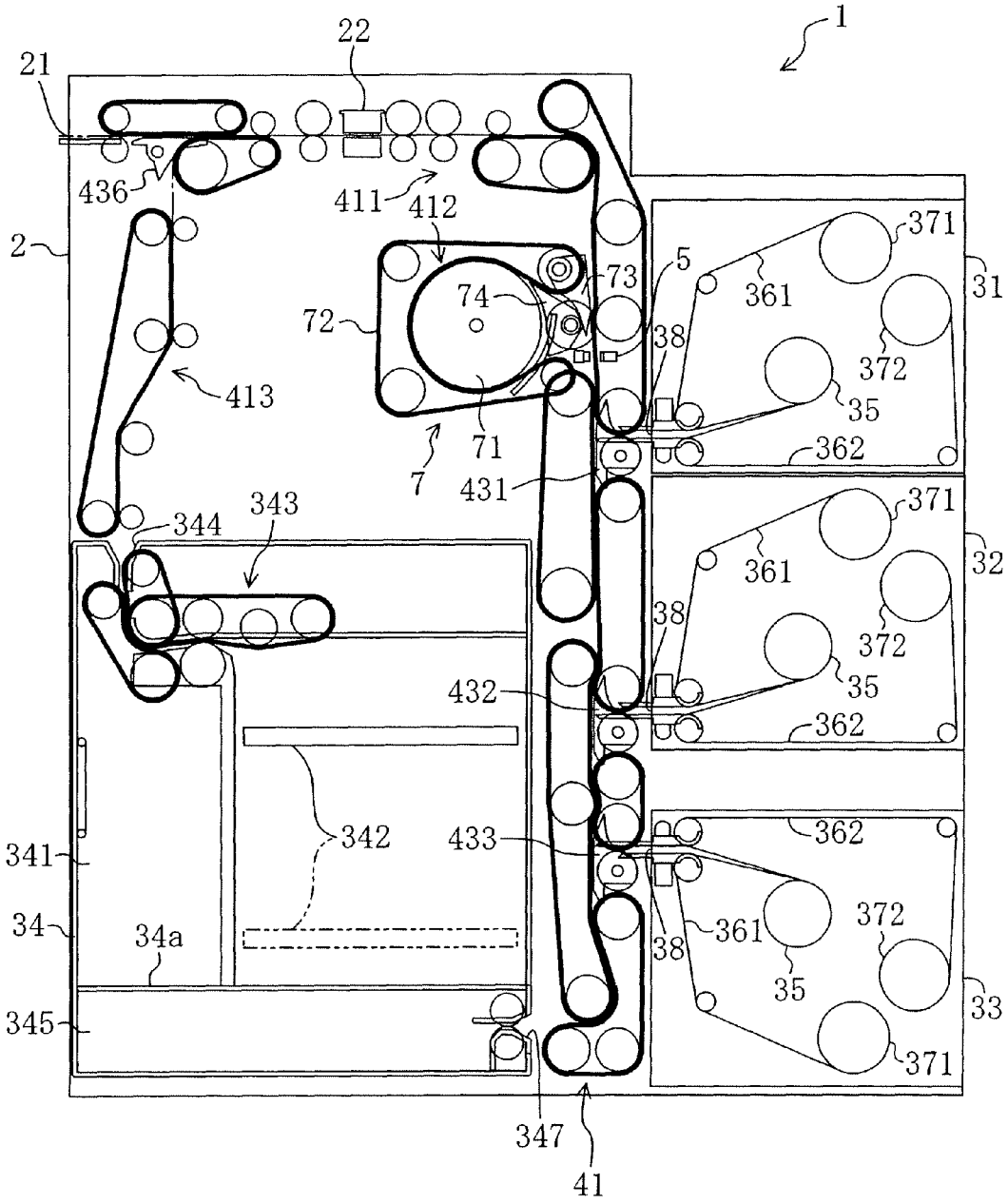
FIG. 1 is a view illustrating the structure of a cash accept/dispense machine.

FIG. 1 shows the internal structure of a cash accept/dispense machine 1 of the present embodiment. The cash accept/dispense machine 1 includes an opening 21 connecting the inside and the outside of a casing 2 and allows a bill to pass through. A discrimination unit 22 is provided in the casing 2 to identify the denomination of the bill, whether the bill is genuine or counterfeit and whether the bill is fit or unfit. In this context, fit bills include recyclable bills. First to third stackers 31 to 33 capable of storing bills therein and delivering the stored bills out are also provided in the casing 2. A cassette 34 is detachably attached to the casing 2. The cash accept/dispense machine 1 further includes a temporarily holding section 7 capable of temporarily holding the bills therein and delivering the bills out. A transport drive section 42 including a transport path 41 connects the opening 21, the discrimination unit 22, the first to third stackers 31 to 33, the cassette 34 and the temporarily holding section 7 and transports the bill and a bunch of bills along the transport path 41 (see FIG. 3). In the following description, "transportation of the bill" may also signify transportation of a bunch of bills.

Figure 3:
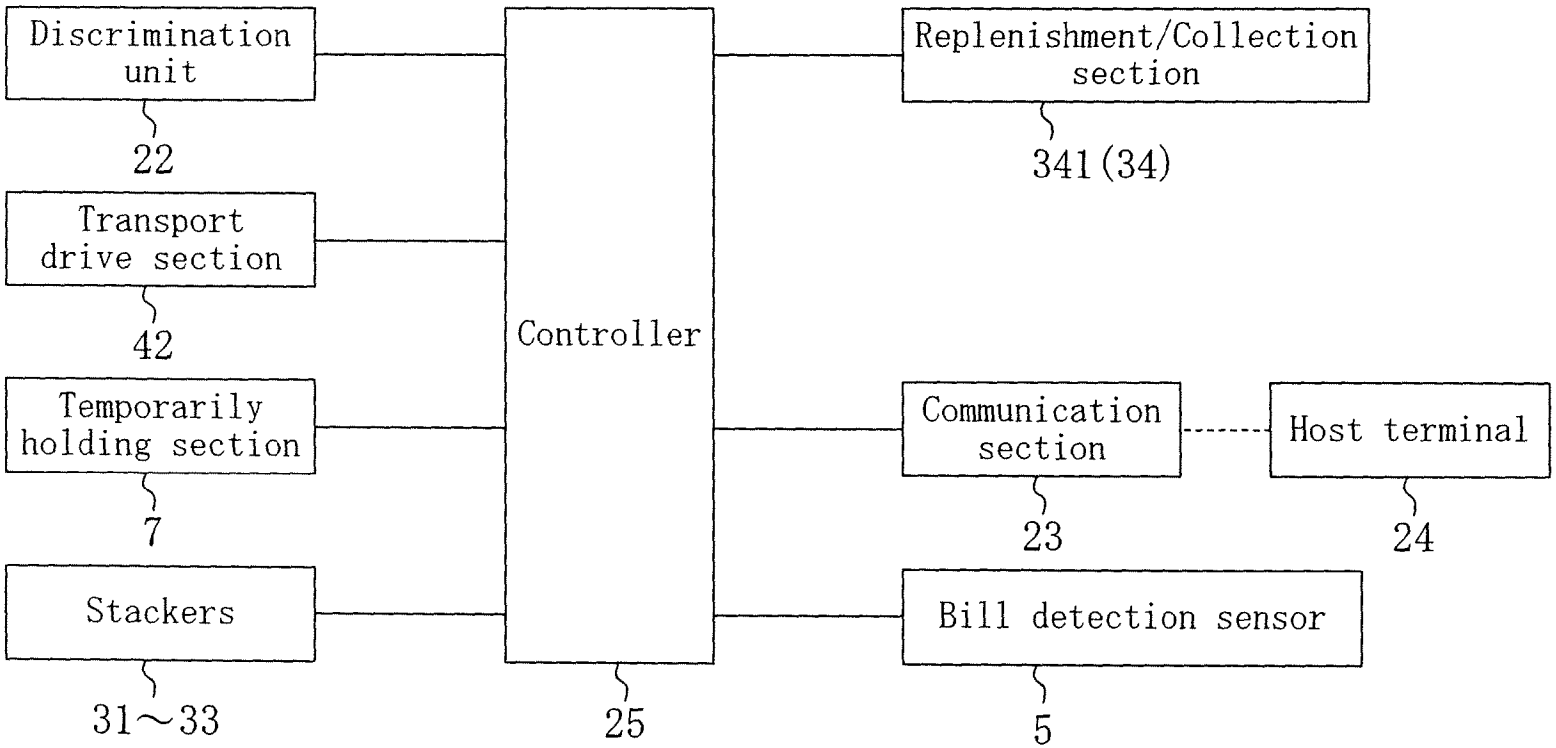
FIG. 3 is a block diagram illustrating the structure for controlling the cash accept/dispense machine.

As shown in FIG. 3, the cash accept/dispense machine 1 further includes a communication section 23 sending/receiving data to/from a host computer 24 through a communication line and a controller 25 controlling the above-described components 22, 23, 31 to 34, 42 and 7. The controller 25 controls the components 22, 23, 31 to 34, 42 and 7 based on a command from the host computer 24 which is connected to the cash accept/dispense machine 1. Accordingly, the cash accept/dispense machine 1 performs various processes such as a bill reception process, a bill discharge process, a bill replenishment process and a bill collection process described later.

The cash accept/dispense machine 1 may be an individually operable device. In this case, the controller 25 is adapted to control the components 22, 23, 31 to 34, 42 and 7 based on a command given by a user through a certain interface.

The cash accept/dispense machine 1 is a so-called recycling cash accept/dispense machine 1. Bills are stored in the stackers 31 to 33 in the bill reception process and are delivered out of the stackers 31 to 33 and discharged through the opening 21 in the bill discharge process.

For easy explanation, the left and right sides of the cash accept/dispense machine shown in FIG. 1 are referred to as the front and rear sides thereof.

The opening 21 is an aperture through which a user feeds the bill into the machine in the bill reception process and through which the bill is delivered to the user in the bill discharge process. As shown in FIG. 1, the opening 21 is provided in a top portion of a front face of the casing 2. When the user feeds a plurality of bills, the opening 21 receives the bills one by one. On the other hand, if there are a plurality of bills to be delivered to the user, the opening 21 discharges the bills in the form of a bunch with the front edges of the bills being aligned as described later.

The first to third stackers 31 to 33 are vertically piled in the casing 2 in this order from the top to the bottom. The first to third stackers 31 to 33 are adapted to store the bills classified by denomination, where the bills are, for example, discharged from the opening 21 as a change.

Each of the stackers 31 to 33 is a tape winding stacker configured to wind the bills one by one to store them and deliver the stored bills one by one in the reverse order of the winding order. Specifically, a winding roller 35 winding the bills thereon is provided in each of the box-shaped stackers 31 to 33. The winding rollers 35 are rotatable in the clockwise and counterclockwise directions in FIG. 1.

In each of the stackers 31 to 33, the winding roller 35 is combined with a pair of tapes 361 and 362 whose tip ends are fixed to a certain part of the outer circumferential surface of the winding roller 35. The tail ends of the tapes 361 and 362 are fixed to tape rollers 371 and 372 provided in each of the stackers 31 to 33. The tape rollers 371 and 372 rotate in synchronization with the winding roller 35. To be more specific, when the winding roller 35 rotates to reel the tapes 361 and 362, the tape rollers 371 and 372 rotate to unreel the tapes 361 and 362. On the other hand, when the winding roller 35 rotates to unreel the tapes 361 and 362, the tape rollers 371 and 372 rotate to reel the unreeled tapes 361 and 362.

In the front faces of the stackers 31 to 33, ports 38 communicating with the inside and the outside of the stackers 31 to 33 are provided, respectively. The bills come in and out of the stackers 31 to 33 through the ports 38.

For storing the bills in each of the stackers 31 to 33, a bill introduced in the stacker through the port 38 is held between the pair of tapes 361 and 362 and wound on the winding roller 35. In this manner, the stackers 31 to 33 store the bills by winding the bills one by one on the winding rollers 35.

For delivering the bills out of the stackers 31 to 33, the winding rollers 35 are driven in the reverse direction to unreel the bills and the pair of tapes 361 and 362 from the winding rollers 35. In this manner, the bills are delivered one by one out of the stackers 31 to 33 through the ports 38 in the reverse order of the winding order.

The cassette 34 is in the form of an approximately rectangular box. A partition plate **34*a* is provided in a lower part of the cassette 34 to divide the space in the cassette 34 into two regions. Upper one of the two regions is a replenishment/collection section 341 capable of storing the bills therein and delivering the stored bills out. The lower region is a reject section 345** capable of storing the bills therein but incapable of delivering the stored bills out.

As described later, the replenishment/collection section 341 stores the bills to replenish the stackers 31 to 33 and stores the bills collected from the stackers 31 to 33. The replenishment/collection section 341 also stores bills which do not have to recycle in the machine (e.g., large denomination bills that are not used as a change). The replenishment/collection section 341 includes storage space for keeping the bills stacked one above the other. A stage 342 is provided in the storage space on which the bills are placed. The stage 342 is vertically displaceable (see the solid and dotted lines in FIG. 1). Specifically, the stage 342 is vertically displaced in accordance with the amount of bills placed thereon. The position of the stage 342 is controlled such that the topmost among the bills stacked in the storage space is always located at the top end of the storage space.

In the replenishment/collection section 341, a conveyor belt system 343 including a belt running on a plurality of pulleys is provided. The conveyor belt system 343 is arranged such that the belt comes to contact with the topmost bill of the bill stack placed in the storage space. Further, the conveyor belt system 343 communicates with a port 344 opening in the top face of the cassette 34. As detailed later, the thus-configured conveyor belt system 343 places a single bill or a bunch of bills introduced in the replenishment/collection section 341 through the port 344 on the stage 342. Further, the conveyor belt system 343 delivers the bills placed on the stage 342 one by one and discharges them out of the replenishment/collection section 341 through the port 344.

The reject section 345 is adapted to store the rejected bills. An inlet 347 communicating with the inside and the outside of the reject section 345 is formed in the rear wall of the cassette 34. The bills enter the reject section 345 through the inlet 347.

The transport path 41 is provided by combining transport belts running on pulleys, guide plates (not shown) guiding the bill, pairs of rollers sandwiching the bill in the thickness direction and branch elements arranged at predetermined positions in the transport path 41. Every belt is able to rotate forward and backward. The transport path 41 is able to transport not only a single bill but also a bunch of bills. The transport path 41 is roughly divided into a main transport path 411 and a branch transport path for the cassette 413.

The main transport path 411 is a transport path connecting the opening 21, the stackers 31 to 33 and the reject section 345. The main transport path 411 extends horizontally from the opening 21 to pass the discrimination unit 22 and then extends downward along the vertically piled stackers 31 to 33. The front end of the main transport path 411 communicates with the inlet 347 of the reject section 345 of the cassette 34 attached to the casing 2.

Branch transport paths for the stackers branch out from certain parts of the main transport path 411 to extend to the first to third stackers 31 to 33, respectively.

At the junctions of the branch transport paths and the main transport path, branch elements 431, 432 and 433 for changing the transport direction of the bill are provided, respectively. Each of the branch elements 431, 432 and 433 is a claw-shaped member which is pivotable about a pivot axis. The pivotal movement of the branch elements 431, 432 and 433 is controlled by the controller 25 such that the bill traveling along the main transport path 411 is sent to any one of the first to third stackers 31 to 33 and the reject section 345 or the bill discharged out of any one of the first to third stackers 31 to 33 is sent toward the opening 21 along the main transport path 411.

The branch transport path for the cassette 413 branches out from part of the main transport path 411 between the opening 21 and the discrimination unit 22. The front end of the branch transport path for the cassette 413 is connected to the port 344 of the cassette 34 attached to the casing 2. At the junction of the main transport path 411 and the branch transport path for the cassette 413, a branch element 436 made of a claw-shaped member which is pivotable about a pivot axis is provided. The controller 25 controls the pivotal movement of the branch element 436 such that the bill traveling along the main transport path 411 toward the opening 21 is sent directly to the opening 21 or to the replenishment/collection section 341. Or alternatively, the bill delivered out of the replenishment/collection section 341 may be sent to the main transport path 411.

The temporarily holding section 7 is provided between the discrimination unit 22 and the first stacker 31 in the main transport path 411.

Figure 2:
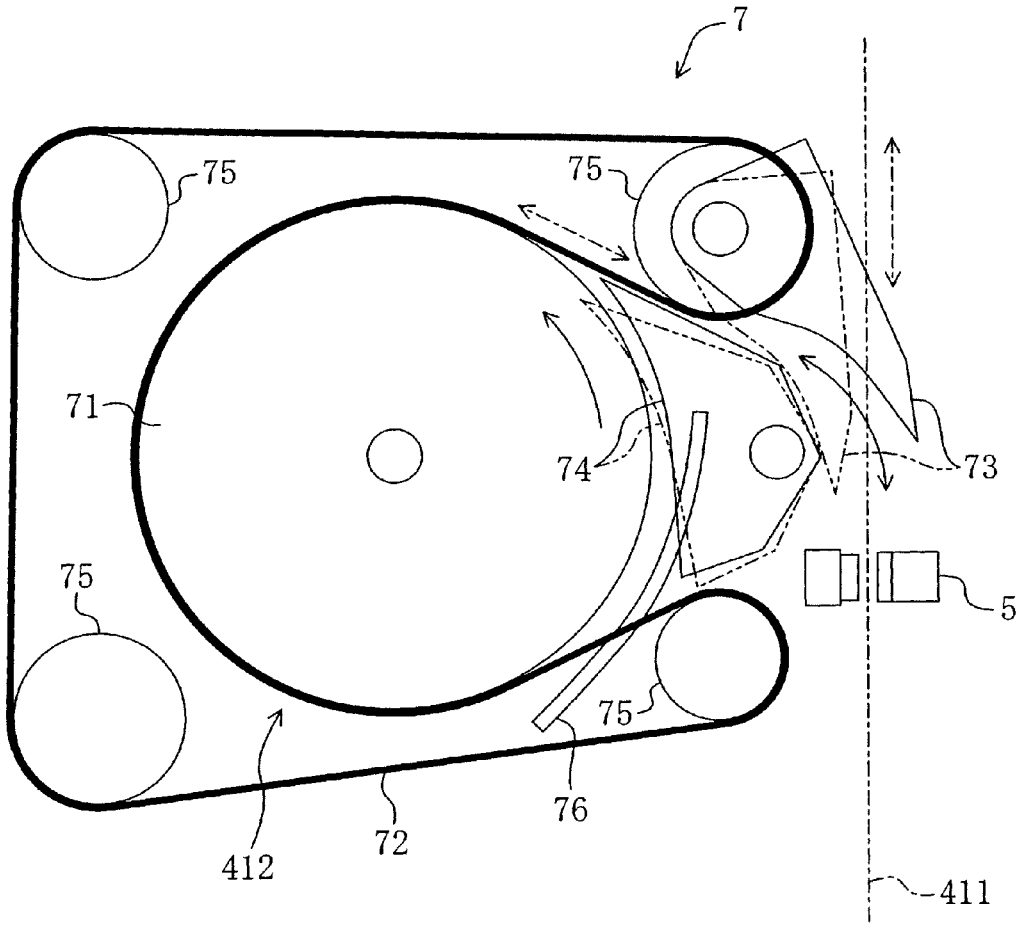
FIG. 2 is an enlarged view illustrating a temporarily holding section.

As shown in the enlarged view of FIG. 2, the temporarily holding section 7 includes a roller 71, a belt 72, a branch element 73 and a switching element 74.

The roller 71 is located on the side of the main transport path 411 and capable of rotating about its center axis in the clockwise and counterclockwise directions. Though not shown, the roller 71 is driven to rotate by a motor capable of controlling the angle of rotation and/or the rotation speed (e.g., a stepping motor or a servo-motor). Therefore, as described later, a looped transport path 412 including the roller 71 is able to transport the sheet independently from the main transport path 411.

The belt 72 is a flat belt and wound on the roller 71 and four pulleys 75 arranged to surround the roller 71 such that one of belt surfaces is in contact with the pulleys 75 and the other belt surface is in contact with the roller 71. The belt 72 wound on the roller 71 is in contact with about ¾ of the total circumference of the roller 71 and therefore the contact angle is relatively large. The belt 72 travels on the pulleys 75 and the roller 71 as the roller 71 rotates. Accordingly, a looped transport path 412 transporting the bill between the outer circumference surface of the roller 71 and one of the surfaces of the belt 72 is provided in the temporarily holding section 7. As described later, the looped transport path 412 functions as a stacking system (bunching system) for stacking a plurality of bills into a bunch. Thus, the temporarily holding section 7 of the cash accept/dispense machine 1 has a stacking function.

The branch element 73 is provided between the temporarily holding section 7 and the main transport path 411. The branch element 73 is a claw-shaped member pivotable about a certain pivot axis. The state of the branch element 73 is switched by the controller 25 between a slanted state indicated by a solid line and a vertical state indicated by a dotted line in FIG. 2. When the branch element 73 is in the slanted state, the bill traveling along the main transport path 411 toward the opening 21 is sent to the temporarily holding section 7 or the bill is sent back to the main transport path 411 from the temporarily holding section 7 (see a solid arrow in FIG. 2).

When the branch element 73 is in the vertical state, the bill traveling along the main transport path 411 toward the opening 21 is directly sent to the opening 21 or the bill traveling along the main transport path 411 toward the stacker is directly sent to the stacker (see a dotted arrow in FIG. 2).

The switching element 74 is arranged to face part of the roller 71 not covered with the belt 72. Just like the switching element 73, the switching element 74 is also a claw-shaped member which is pivotable about a certain pivot axis. The state of the switching element 74 is switched by the controller 25 between a vertical state indicated by a solid line and a slanted state indicated by a dotted line in FIG. 2.

When the switching element 74 is in the vertical state, the bill revolves along the looped transport path 412 in the counterclockwise direction (see a solid arrow in FIG. 2). On the other hand, when the switching element 74 is in the slanted state, the bill is sent from the main transport path 411 to the looped transport path 412 in the counterclockwise direction or the bill traveling along the looped transport path 412 in the clockwise direction is sent from the temporarily holding section 7 to the main transport path 411 (see a dotted arrow in FIG. 2).

A guide 76 is also arranged to face the part of the roller 71 not covered with the belt 72. The guide 76 helps the bill to revolve along the looped transport path 412.

Several bill detection sensors for detecting the arrival of the bill, such as optical sensors, are provided at predetermined positions in the transport path 41. FIG. 1 shows only a bill detection sensor 5 provided in the main transport path 411 to be closer to the stacker than to the junction to the temporarily holding section 7. The bill detection sensor 5 is used in a bill stacking procedure described later.

Though not shown, the transport drive section 42 includes a motor as a transport driver source capable of controlling the angle of rotation and/or the rotation speed. For example, the motor may be a stepping motor or a servo-motor.

Figure 4:
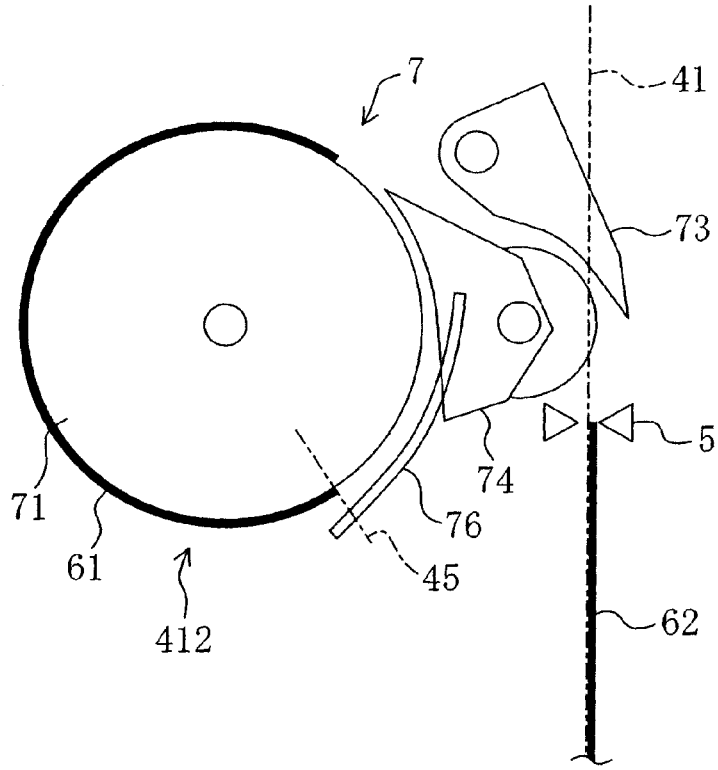
FIG. 4 is a view illustrating the first step of a bill stacking procedure in the temporarily holding section.
Figure 5:
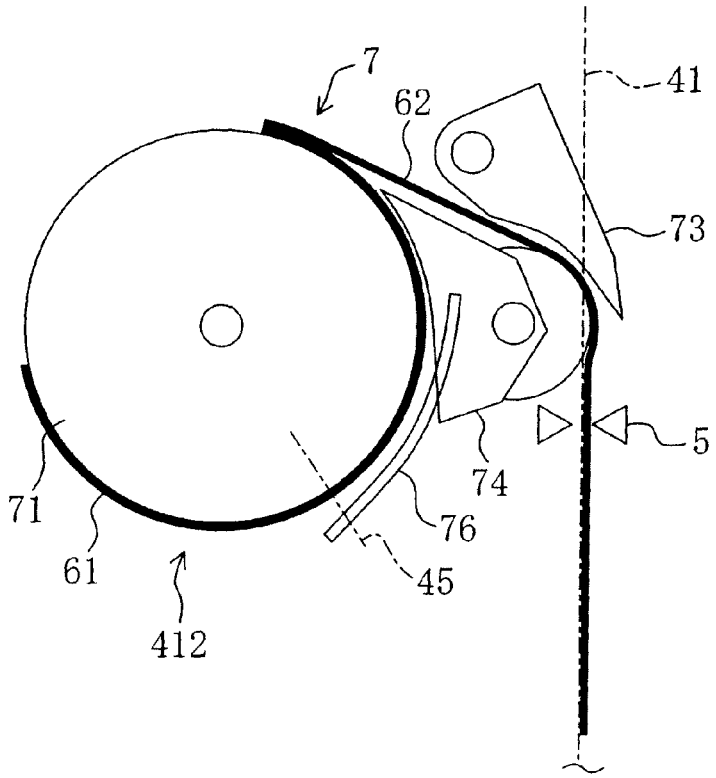
FIG. 5 is a view illustrating the second step of the bill stacking procedure in the temporarily holding section.
Figure 6:
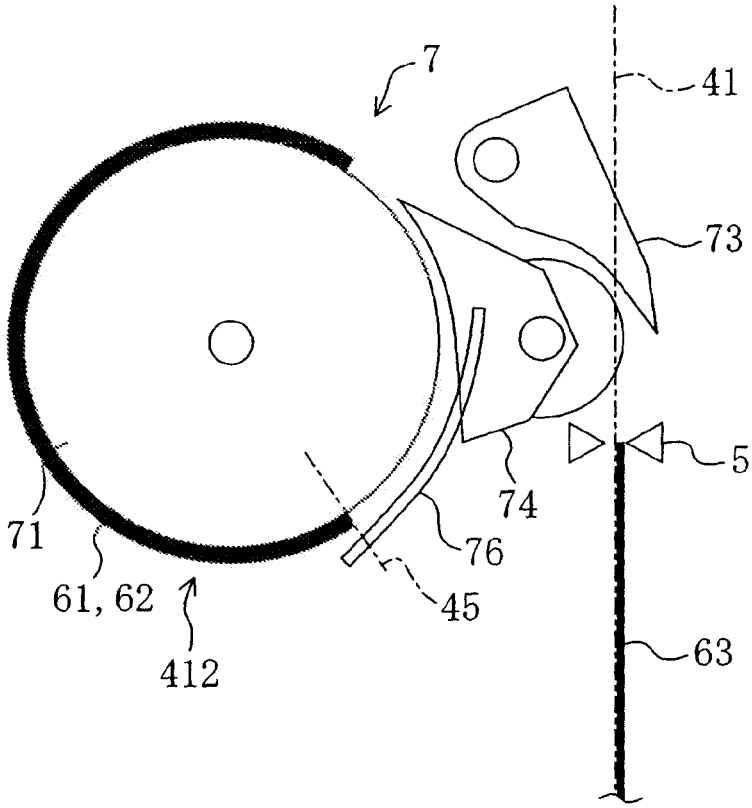
FIG. 6 is a view illustrating the third step of the bill stacking procedure in the temporarily holding section.

Referring to FIGS. 4 to 6, the bill stacking procedure by the temporarily holding section 7 is now explained in detail. In FIGS. 4 to 6, the belt 72 and the pulleys 75 are omitted for easy understanding. In the following description, the procedure of stacking the bills delivered out of the first to third stackers 31 to 33 is explained. However, as described later, the bill stacking procedure by the temporarily holding section 7 is not limited thereto.

First, the bill delivered out of any one of the first to third stackers 31 to 33 (a first bill 61) travels along the main transport path 411 toward the opening 21 and arrives at the junction to the temporarily holding section 7. At this time, the branch element 73 is slanted as shown in FIG. 4. Therefore, the first bill 61 is sent to the temporarily holding section 7. Then, the first bill 61 is situated at a predetermined standby position 45 on the looped transport path 412.

With the first bill 61 kept at the standby position, another bill (a second bill 62) is delivered out of any one of the first to third stackers 31 to 33 and sent toward the opening 21 along the main transport path 411. The second bill 62 is detected by the bill detection sensor 5. To be more specific, the bill detection sensor 5 detects that the front edge of the second bill 62 has arrived at the sensor position.

Based on the detection result of the bill detection sensor 5, the controller 25 controls the transport drive section 42 and the temporarily holding section 7 such that the first bill 61 on the looped transport path 412 and the second bill 62 on the main transport path 411 travel in synchronization with each other. Thus, as shown in FIG. 5, the front edges of the two bills 61 and 62 are aligned at a predetermined position in the looped transport path 412. In this state, the two bills 61 and 62 travel along the looped transport path 412. Thus, the first and second bills 61 and 62 are stacked into a bunch with their front edges being aligned.

The bunch of the bills 61 and 62 is situated at the standby position 45 on the looped transport path 412 (see FIG. 6). Then, when another bill (a third bill 63) is detected by the bill detection sensor 5, the bunch of the bills 61 and 62 travels in synchronization with the third bill 63. Thus, the bills are stacked at the predetermined position on the looped transport path 412 with their front edges being aligned.

Every time a bill or a bunch of bills revolves along the looped transport path 412 in the temporarily holding section 7, additional bills are stacked on the bill or the bunch of bills one after another. Since the temporarily holding section 7 makes it possible stack the bills with their front edges being aligned, a neatly aligned bunch is formed even if the bills are different in size. However, the number of bills stackable in the temporarily holding section 7 is limited depending on the maximum thickness of the bills traveling along the looped transport path 412, the positional relationship between the roller 71 and the guide 76 and the maximum thickness of the bills traveling along the transport path 41.

Now, the processes performed by the thus-configured cash accept/dispense machine 1 will be explained in detail with reference to FIG. 7 to FIG. 11.

Figure 7:
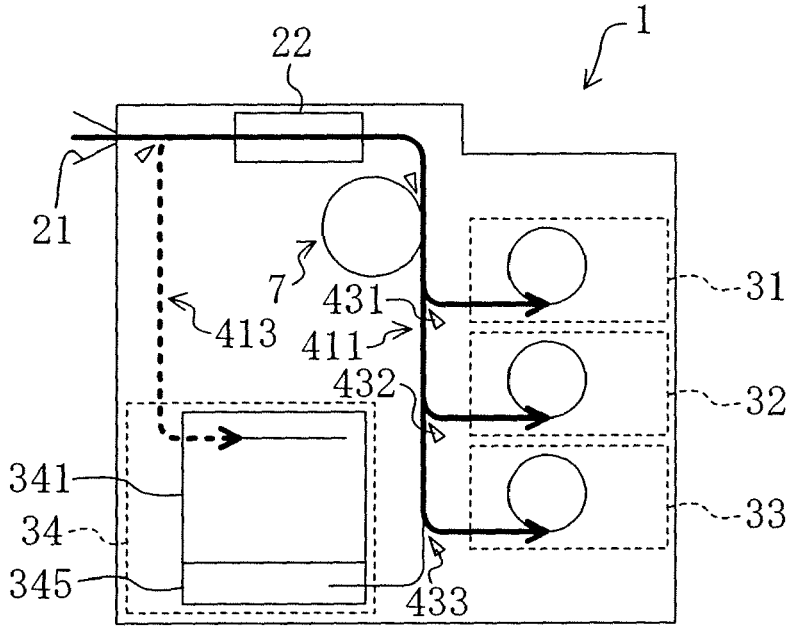
FIG. 7 is a view illustrating a bill transport path selected in a bill reception process without using the temporarily holding section.

FIG. 7 shows a bill transport path for the bill reception process. In the bill reception process explained herein, the temporarily holding section 7 is not used. As described later, it is possible to use the temporarily holding section 7 in the bill reception process. For example, whether the temporarily holding section 7 is used or not in the bill reception process may be determined by the user's operation. The bill reception process is performed rapidly if the temporarily holding section 7 is not used.

In the bill reception process, a user feeds the bills one by one into the casing through the opening 21. The discrimination unit 22 identifies each of the bills whether it is acceptable or not. The bill identified as acceptable is sent toward the stackers along the main transport path 411. The rejected bill which is not identified as acceptable is discharged out of the casing through the opening 21.

The controller 25 controls the branch elements 431, 432 and 433 based on the identification result of the discrimination unit 22. As a result, the bill sent toward the stackers is stored in any one of the first to third stackers 31 to 33.

A bill which does not have to recycle in the machine is sent to the replenishment/collection section 341 through the branch transport path for the cassette 413 and stored therein (see the dotted arrow in FIG. 7). The bill which does not have to recycle in the machine may be stored in the reject section 345.

Figure 8:
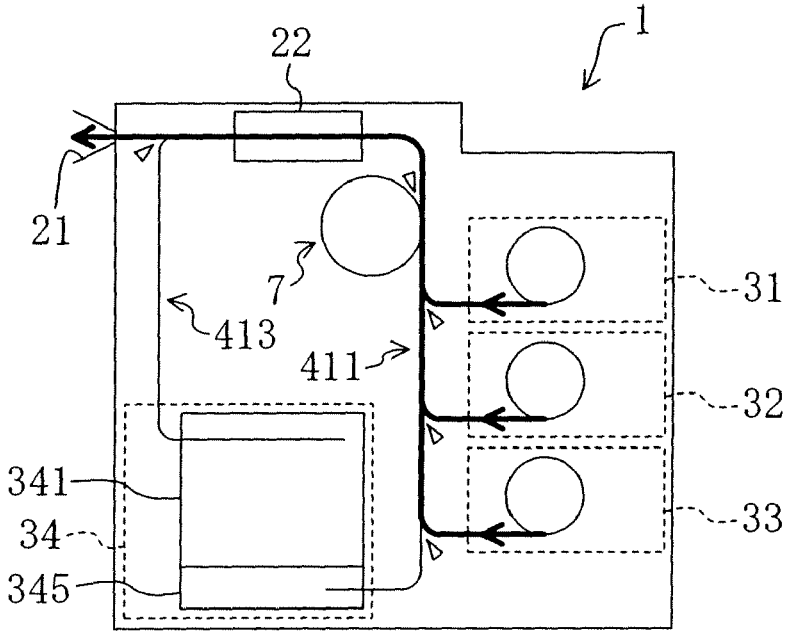
FIG. 8 is a view illustrating a bill transport path selected in a process of discharging a single bill through an opening.

FIG. 8 shows the bill discharge process in which the bill is discharged through the opening 21 without using the temporarily holding section 7. The bill discharge process includes a process of delivering a bill of designated denomination from the stackers 31 to 33 to the user (a so-called payout process) and a canceling process of delivering the bill once fed into the machine back to the user when the bill reception is cancelled in the bill reception process without using the temporarily holding section 7.

To be more specific, in the bill discharge process, the bill delivered out of any one of the first to third stackers 31 to 33 travels along the main transport path 411 and is discharged through the opening 21. When two or more bills are discharged, they are discharged one by one through the opening 21.

Figure 9:
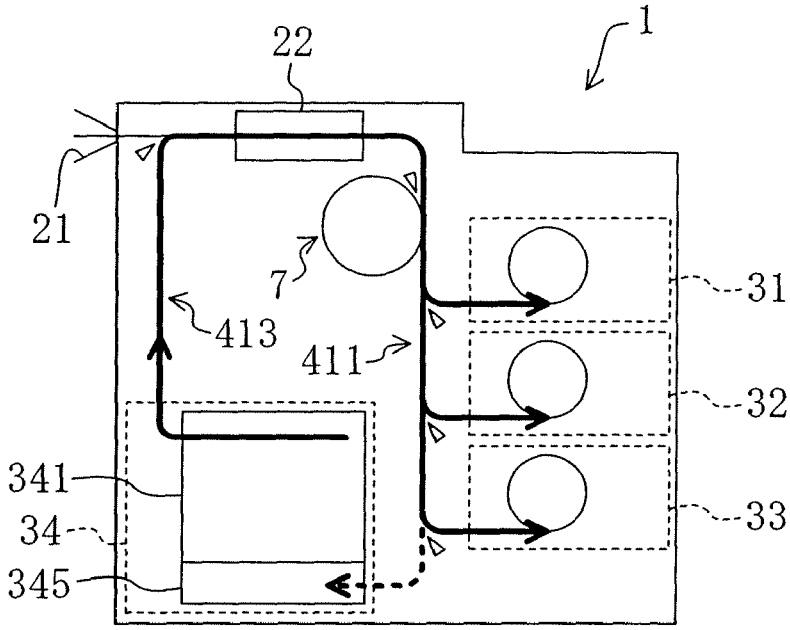
FIG. 9 is a view illustrating a bill transport path selected in a process of replenishing stackers with the bills sent from a cassette.

FIG. 9 shows a bill replenishment process for replenishing the stackers 31 to 33 with the bills. In the bill replenishment process, the cassette 34 including the replenishment/collection section 341 containing the bills is attached to the casing 2 and the bills in the replenishment/collection section 341 are transported to and stored in the stackers 31 to 33. In the replenishment/collection section 341, the bills may be stacked in a state where different denominations are mixed.

Specifically, in the bill replenishment process, the bills are delivered one by one from the replenishment/collection section 341. Each of the bills passes the branch transport path for the cassette 413, enters the main transport path 411 and identified by the discrimination unit 22. If the bill is identified as storable, it is sent to the stackers along the main transport path 411 and stored in any one of the stackers 31 to 33 corresponding to the denomination of the bill (see a solid arrow in FIG. 9). If the bill is not identified as storable, the bill is rejected and sent to the reject section 345 along the main transport path 411 and stored therein (see a dotted arrow in FIG. 9).

In the bill replenishment process, an initial stock of the bills available at the start of the cash accept/dispense machine 1 is stored into the stackers 31 to 33 from a single cassette 34, which makes the operation highly convenient. Further, since only a single cassette 34 is used, the cassette 34 is easily transported and the measures against thief are easily taken.

Figure 10:
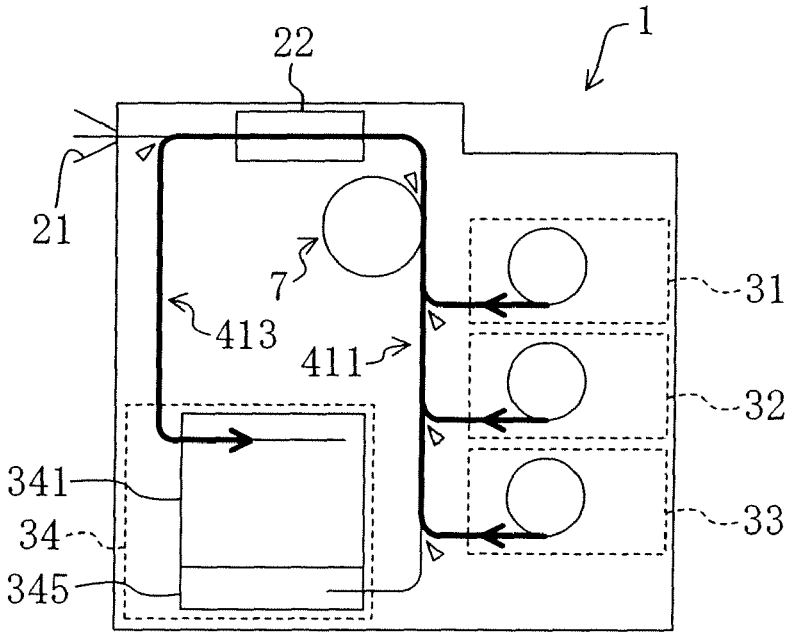
FIG. 10 is a view illustrating a bill transport path selected in a process of collecting the bills from the stackers to the cassette.

FIG. 10 shows the bill collection process of collecting the bills stored in the stackers 31 to 33 in the replenishment/collection section 341 of the cassette 34. In this bill collection process, the bills are delivered one by one from the stackers 31 to 33 and sent along the main transport path 411 toward the opening 21. Each of the bills is identified by the discrimination unit 22. After the identification, the bill travels along the branch transport path for the cassette 413 to the replenishment/collection section 341 and stored therein. In this manner, when every bill stored in the stackers 31 to 33 is collected in the replenishment/collection section 341, the cassette 34 is detached from the casing 2. Thus, the bills in the cash accept/dispense machine 1 are collected.

In the bill collection process, the bills may be sent to and stored in the replenishment/collection section 341 without execution of identification when passing through the discrimination unit 22. In this case, the identification and counting of the bills may be carried out in the process of taking the bills out of the cassette 34 after the cassette 34 is detached from the casing.

Figure 11:
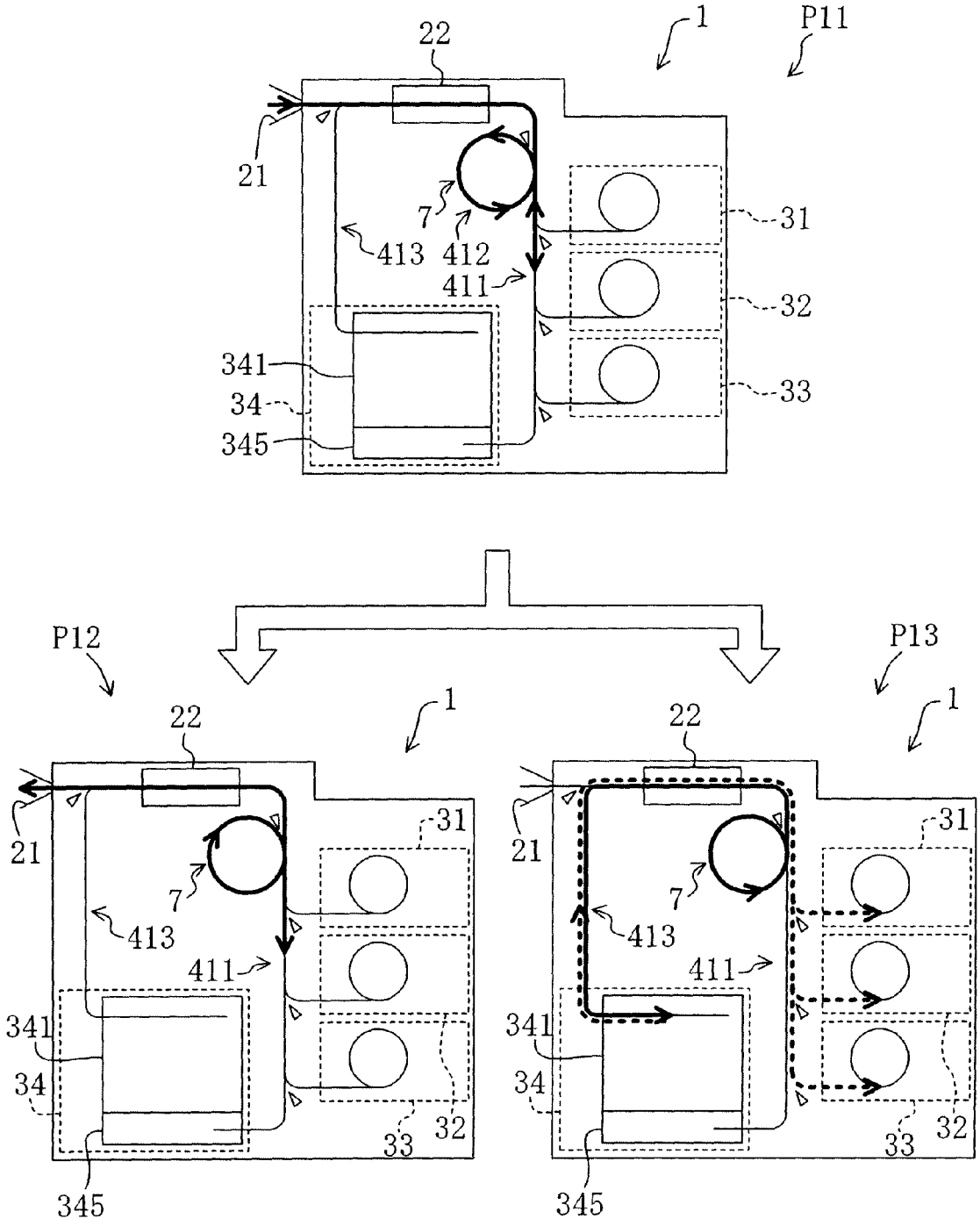
FIG. 11 is a view illustrating a bill transport path selected in a bill reception process using the temporarily holding section.

FIG. 11 shows the steps of the bill reception process using the temporarily holding section 7. As described above, the user feeds the bills one by one through the opening 21 in the bill reception process. Each of the bills is then identified by the discrimination unit 22. If the bill is identified as acceptable, it is sent to the temporarily holding section 7. Each of the bills passes the junction of the main transport path 411 and the temporarily holding section 7 and then goes back into the temporarily holding section 7. If the bill is not identified as acceptable, the bill is rejected and discharged through the opening 21.

The bills fed through the opening 21 are sent to the temporarily holding section 7 one after another. As described above, the bills are stacked into a bunch with their front edges being aligned on the looped transport path 412 of the temporarily holding section 7 (see step P11).

When the bill reception process is cancelled by the user, the roller 71 of the temporarily holding section 7 is rotated in the reverse direction to transport the bunch of bills from the temporarily holding section 7 to the main transport path 411 in step P12. Then, the bunch of bills travels along the main transport path 411 in the reverse direction toward the opening 21 and is discharged through the opening 21.

When the bill reception process is confirmed by the user, the bunch of bills is delivered from the temporarily holding section 7 to the main transport path 411. Then, it travels along the main transport path 411 and the branch transport path for the cassette 413 to the replenishment/collection section 341 and is temporarily stored therein in step P13 (see a solid arrow in FIG. 11).

The bills in the bunch are then delivered one by one out of the replenishment/collection section 341 by the conveyor belt system 343. Each of the delivered bills passes the discrimination unit 22 and is stored in any one of the first to third stackers 31 to 33 based on the identification result (see a dotted arrow in FIG. 11).

As described above, the number of the bills stackable in the temporarily holding section 7 is limited. Therefore, the maximum number of the bills that the user can feed into the opening 21 at one time in the bill reception process is determined in advance such that a large number of bills exceeding the maximum number are not fed into the port. Even if the maximum number is not determined in advance, and when the maximum number of bills stackable in the temporarily holding section 7 is fed into the opening 21, the feeding of the bills into the opening 21 is suspended for a while, during which the bills stacked in the temporarily holding section 7 are sent to and stored in the stackers 31 to 33. Alternatively, the bills stacked in the temporarily holding section 7 are moved to the replenishment/collection section 341 during the suspension, and then the feeding is restarted. The bills moved to the replenishment/collection section 341 are sent to and stored in the stackers 31 to 33 after the feeding is completed. That is, the bill reception process may be divided and performed in several times.

Figure 12:
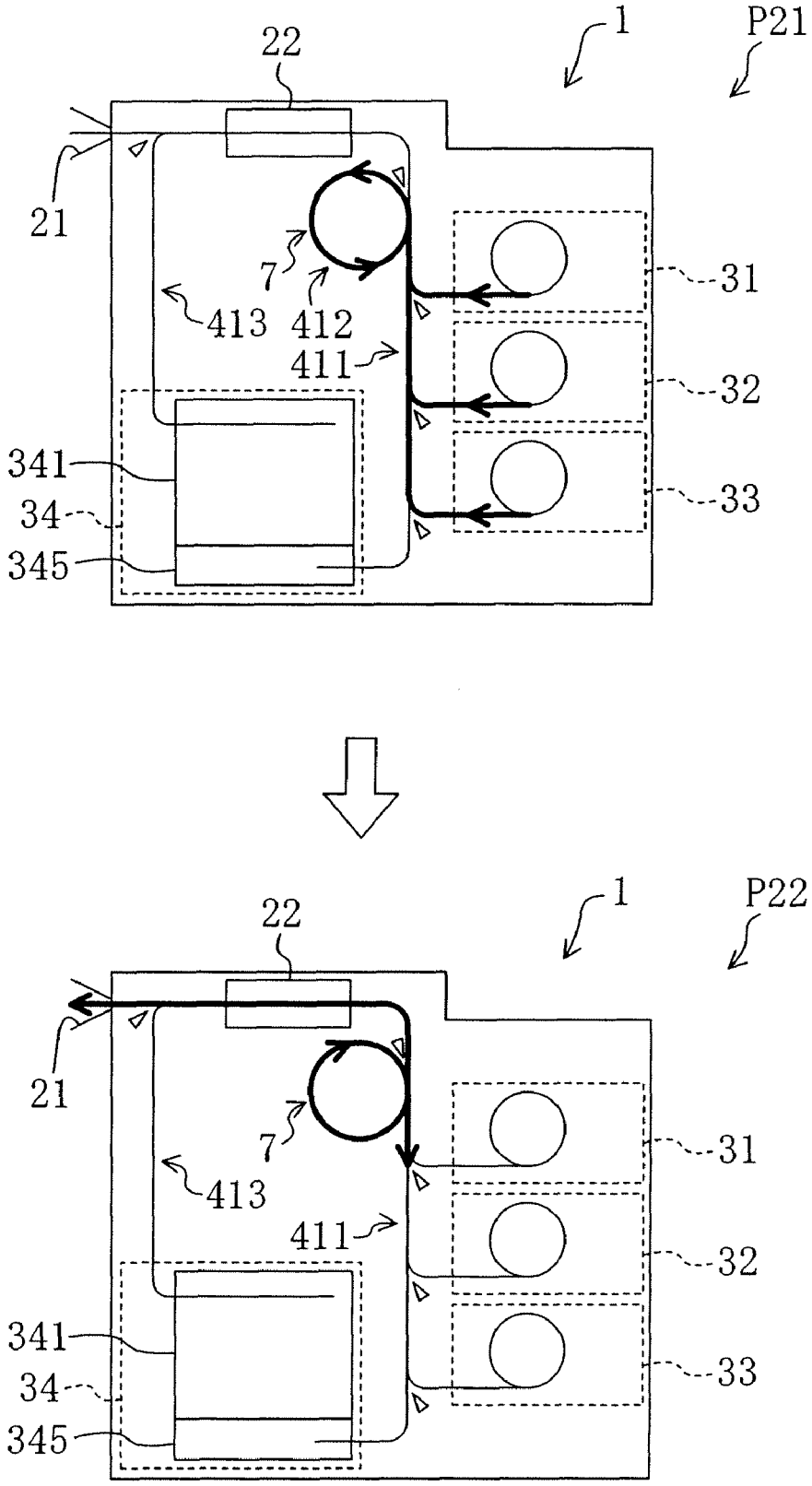
FIG. 12 is a view illustrating a bill transport path selected in a process of discharging a plurality of bills through the opening.

FIG. 12 shows the steps of the bill discharge process (payout process) for discharging two or more bills. In the bill discharge process, the two or more bills are stacked into a bunch with their front edges being aligned in the temporarily holding section 7, and then the bunch is discharged through the opening 21.

In the bill discharge process, the bills are delivered one by one from any one of the first to third stackers 31 to 33. The bills are sent to the temporarily holding section 7 and stacked into a bunch on the looped transport path 412 of the temporarily holding section 7 as described above with their front edges being aligned. (see step P21).

When a required number of bills are stacked in step P21, the roller 71 of the temporarily holding section 7 is rotated in the reverse direction in step P22 to send the bunch of bills from the temporarily holding section 7 to the main transport path 411. Then, the bunch travels along the main transport path 411 in the reverse direction and is discharged through the opening 21.

The bills delivered out of any one of the first to third stackers 31 to 33 may be identified by the discrimination unit 22 first. Then, they are sent to the temporarily holding section 7 and stacked into a bunch.

In the bill discharge process, it is preferable that the maximum number of bills discharged from the opening 21 is determined in advance such that a large number of bills exceeding the maximum number cannot be discharged. When the maximum number is not determined in advance, and when the maximum number of the bills stackable in the temporarily holding section 7 is discharged, the bill discharge may be divided and performed in several times. In this case, it is displayed on the cash accept/dispense machine 1 that the bill discharge is currently in progress.

As described above, when a plurality of bills are discharged out of the cash accept/dispense machine 1, the bills are stacked into a bunch with their front edges being aligned and then the bunch is discharged through the opening 21. Therefore, even if the bills are different in size, the user is able to grab the bunch of bills easily and the bills are less likely to escape from the user's hand.

The stacking system which makes it possible to stack the bills into a bunch includes the looped transport path 412. The bills are stacked by revolving the bill and the bunch of bills on the looped transport path 412. This simplifies the structure of the stacking system and the bills are stacked at high speed.

The looped transport path 412 is provided in the temporarily holding section 7. Therefore, as compared with the case where the stacking system is configured of a looped transport path separate from the temporarily holding section 7, space for the stacking system is saved. As a result, the cash accept/dispense machine 1 is downsized.

As the storage section for storing the bills, the cash accept/dispense machine 1 includes the winding stackers (the first to third stackers 31 to 33). Therefore, the bills are delivered one by one from the stackers and sent to the temporarily holding section 7 with reliability. Accordingly, the stacking of the bills is performed with reliability. However, the storage section is not limited to the tape winding stackers. Any kinds of storage section may be adopted as long as it is capable of delivering the bills. If there is a possibility that the storage section delivers two stacked bills at a time, the stacking state of the bills is detected until the bills arrive at the temporarily holding section 7. In this way, the bills are stacked one by one with reliability.

In the temporarily holding section 7, the bills are stacked into a bunch with their front edges being aligned. However, this is not limitative. The temporarily holding section 7 may stack the bills into a bunch with other required parts thereof being aligned. Therefore, the bills may be stacked with their rear edges being aligned or with their centers being aligned.

An object handled by the sheet handling device of the present invention is not limited to the bills. The sheet handling device is able to handle every kind of sheets such as checks and tickets as well as the bills.

The sheet handling device is not limited to a device which stores and discharges sheets (a device which receives and discharges the bills). The sheet handling device may be a device which only stores or discharges the sheets.

The sheet handling device may be applicable to various kinds of devices such as self-service registers used in various stores, ticket dispensers, parking fee registers, etc.

It should be noted that the present invention is not limited to the above embodiment and various modifications are possible within the spirit and essential features of the present invention. The above embodiment shall be interpreted as illustrative and not in a limiting sense. The scope of the present invention is specified only by the following claims and the description of the specification is not limitative at all. Further, it is also to be understood that all the changes and modifications made within the scope of the claims fall within the scope of the present invention.

What is claimed is:

1. A sheet handling device comprising:

a casing having an opening through which a sheet including at least one cash bill passes;

a discrimination section for discriminating at least a type of sheet;

a storage section provided in the casing to store the sheet based on a discrimination determination of the discrimination section;

a main transport path connecting the opening and the storage section;

a temporarily holding section provided in the main transport path to temporarily hold the sheet;

a transport section transporting the sheet along the main transport path;

a detection section provided at a predetermined detection position in the main transport path to detect the arrival of the sheet traveling along the main transport path at the detection position; and a controller controlling the storage section, the temporarily holding section and the transport section based on the detection result of the detection section, wherein the temporarily holding section includes a looped transport path capable of transporting the sheet in a revolving fashion independently from the main transport path and the controller performs a procedure comprising the steps of:

(I) transporting the sheet traveling along the main transport path to the looped transport path of the temporarily holding section, (II) transporting another sheet along the main transport path, (III) controlling the transportation of the sheet on the looped transport path and the transportation of said another sheet on the main transport path in response to the arrival of said another sheet at the detection position such that said another sheet is transported to the looped transport path and the sheets are stacked into a bunch at a predetermined position in the looped transport path with certain parts of the sheets being aligned and (IV) repeating the steps (II) and (III) as required, wherein at least one of said sheets includes a cash bill.

2. The sheet handling device of claim 1, wherein the controller further performs the step of:

(V) transporting the bunch formed in the temporarily holding section along the main transport path and discharging the bunch out of the casing through the opening.

3. The sheet handling device of claim 1, wherein, when two or more sheets are fed into the casing through the opening one by one, the controller is adapted to stack the sheets into a bunch in the temporarily holding section with certain parts of the sheets being aligned.

4. The sheet handling device of claim 1, wherein, when two or more sheets are discharged out of the casing, the controller is adapted to deliver the two or more sheets out of the storage section one by one, stack the delivered sheets into a bunch in the temporarily holding section with certain parts of the sheets being aligned and discharge the bunch out of the casing through the opening.

5. The sheet handling device of claim 1, wherein the storage section is adapted to wind the sheets one by one to store the sheets in the storage section and deliver the wound sheets one by one out of the storage section.

6. The sheet handling device of claim 5, further comprising a delivery section storing the bunch formed in the temporarily holding section and delivering the sheets one by one from the bunch, wherein the controller is adapted to transport the bunch formed in the temporarily holding section to the delivery section and store the sheets delivered out of the delivery section one by one in the storage section.

7. The sheet handling device of claim 1, further comprising a cassette which is detachably attached to the casing and capable of storing the sheets to replenish the storage section and the sheets collected from the storage section.

8. A sheet handling method for discharging a sheet contained in a storage section out of a casing through an opening, the sheet including at least one cash bill, the storage section storing the sheet based on a type of sheet, and the method comprising the steps of:

(i) transporting a sheet delivered out of the storage section along a main transport path and transporting the sheet to a looped transport path in a temporarily holding section provided in the main transport path;

(ii) delivering another sheet out of the storage section and transporting said another sheet along the main transport path;

(iii) controlling the transportation of the sheet on the looped transport path and the transportation of said another sheet on the main transport path in response to the arrival of said another sheet at a predetermined position in the main transport path such that said another sheet is transported to the looped transport path and the sheets are stacked into a bunch at a predetermined position in the looped transport path with certain parts of the sheets being aligned;

(iv) repeating the steps (ii) and (iii) as required and (v) transporting the bunch formed in the temporarily holding section along the main transport path and discharging the bunch out of the casing through the opening, wherein at least one of said sheets includes a cash bill.

9. A sheet handling method for storing a sheet fed through an opening, the method comprising the steps of:

(i) transporting the sheet which includes at least a cash bill, and is fed through the opening along a main transport path;

(ii) discriminating at least a type of the sheet;

(iii) transporting the sheet to a looped transport path in a temporarily holding section provided in the main transport path;

(iv) discriminating and transporting another sheet fed through the opening along the main transport path;

(v) controlling the transportation of the sheet on the looped transport path and the transportation of said another sheet on the main transport path in response to the arrival of said another sheet at a predetermined position in the main transport path such that said another sheet is transported to the looped transport path and the sheets are stacked into a bunch at a predetermined position in the looped transport path with certain parts of the sheets being aligned; and (vi) repeating the steps (iv) and (v) every time the sheet is fed through the opening.

10. The sheet handling method of claim 9, further comprising the step of (vii) transporting the bunch formed in the temporarily holding section to a delivery section, delivering the sheets of the bunch one by one out of the delivery section and storing the sheets in a storage section.

11. The sheet handling method of claim 9, further comprising the step of (viii) transporting the bunch formed in the temporarily holding section along the main transport path and discharging the bunch through the opening when the storage of the sheets is cancelled.

12. A sheet handling device comprising:

a casing having an opening through which a sheet passes;

a storage section provided in the casing to store the sheet;

a main transport path connecting the opening and the storage section;

a temporarily holding section provided in the main transport path to temporarily hold the sheet;

a transport section transporting the sheet along the main transport path;

a detection section provided at a predetermined detection position in the main transport path to detect the arrival of the sheet traveling along the main transport path at the detection position; and a controller controlling the storage section, the temporarily holding section and the transport section based on the detection result of the detection section, wherein the temporarily holding section includes a looped transport path capable of transporting the sheet in a revolving fashion independently from the main transport path, the controller performs a procedure comprising the steps of:

(I) transporting the sheet traveling along the main transport path to the looped transport path of the temporarily holding section, (II) transporting another sheet along the main transport path, (III) controlling the transportation of the sheet on the looped transport path and the transportation of said another sheet on the main transport path in response to the arrival of said another sheet at the detection position such that said another sheet is transported to the looped transport path and the sheets are stacked into a bunch at a predetermined position in the looped transport path with certain parts of the sheets being aligned and (IV) repeating the steps (II) and (III) as required, the storage section is adapted to wind the sheets one by one to store the sheets in the storage section, and to deliver the wound sheets one by one out of the storage section, the sheet handling device further comprises a delivery section storing the bunch formed in the temporarily holding section and delivering the sheets one by one from the bunch, and the controller is adapted to transport the bunch formed in the temporarily holding section to the delivery section, and to store tile sheets delivered out of the delivery section one by one in the storage section.

13. A sheet handling method for storing a sheet fed through an opening, the method comprising the steps of:

(i) transporting the sheet fed through the opening along a main transport path and transporting the sheet to a looped transport path in a temporarily holding section provided in the main transport path;

(ii) transporting another sheet fed through the opening along the main transport path;

(iii) controlling the transportation of the sheet on the looped transport path and the transportation of said another sheet on the main transport path in response to the arrival of said another sheet at a predetermined position in the main transport path such that said another sheet is transported to the looped transport path and the sheets are stacked into a bunch at a predetermined position in the looped transport path with certain parts of the sheets being aligned;

(iv) repeating the steps (ii) and (iii) every time the sheet is fed through the opening; and (v) transporting the bunch formed in the temporarily holding section to a delivery section, delivering the sheets of the bunch one by one out of the delivery section and storing the sheets in a storage section.

14. A sheet handling device comprising:

a casing having an opening through which a sheet including at least a cash bill passes;

a discrimination section for discriminating at least a type of the sheet;

a storage section provided in the casing to store the sheet based on a discrimination determination of the discrimination section;

a main transport path connecting the opening and the storage section;

a temporarily holding section provided in the main transport path to temporarily hold the sheet;

a transport section transporting the sheet along the main transport path;

a detection section provided at a predetermined detection position in the main transport path to detect the arrival of the sheet traveling along the main transport path at the detection position; and a controller controlling the storage section, the temporarily holding section and the transport section based on the detection result of the detection section, wherein the temporarily holding section includes a looped transport path which includes a roller and a belt wound around the roller, and is capable of transporting the sheet in a revolving fashion independently from the main transport path, and the controller performs a procedure comprising the steps of (I) transporting the sheet traveling along the main transport path to the looped transport path of the temporarily holding section, (II) transporting another sheet along the main transport path, (III) controlling the transportation of the sheet on the looped transport path and the transportation of said another sheet on the main transport path in response to the arrival of said another sheet at the detection position such that said another sheet is transported to the looped transport path and the sheets are stacked into a bunch at a predetermined position in the looped transport path with certain parts of the sheets being aligned, and (IV) repeating the steps (II) and (III) as required, wherein at least one of said sheets includes a cash bill.

15. The sheet handling device of claim 1, wherein the sheet transported in step (II) of the procedure performed by the controller is a different size than the sheet transported in step (I).

* * * * *